US010414524B2

(12) United States Patent
Chisholm

(10) Patent No.: US 10,414,524 B2
(45) Date of Patent: Sep. 17, 2019

(54) PEELABLE FOIL CONTAINER CLOSURE HAVING A WAVY EDGE

(71) Applicant: Owens-Brockway Glass Container Inc., Perrysburg, OH (US)

(72) Inventor: Brian J Chisholm, Sylvania, OH (US)

(73) Assignee: Owens-Brockway Glass Container Inc., Perrysburg, OH (US)

( * ) Notice: Subject to any disclaimer, the term of this patent is extended or adjusted under 35 U.S.C. 154(b) by 73 days.

(21) Appl. No.: 15/452,409

(22) Filed: Mar. 7, 2017

(65) Prior Publication Data

US 2018/0257838 A1 Sep. 13, 2018

(51) Int. Cl.
*B65B 7/28* (2006.01)
*B65D 77/20* (2006.01)

(52) U.S. Cl.
CPC ..... *B65B 7/285* (2013.01); *B65D 77/2032* (2013.01); *B65D 2577/205* (2013.01)

(58) Field of Classification Search
CPC ..... B65D 51/20; B65D 77/2024; B65D 77/2032; B65D 17/501; B65D 2577/205; B65D 2251/0018; B65D 2543/00537; B65D 43/0212; B65D 2251/0093
USPC ..... 215/40
See application file for complete search history.

(56) References Cited

U.S. PATENT DOCUMENTS

| | | | | |
|---|---|---|---|---|
| D30,613 | S | 4/1899 | Hauck | |
| 1,063,384 | A | 6/1913 | Prell | |
| 1,112,880 | A | 10/1914 | Zonne | |
| D48,033 | S | 10/1915 | Kaye | |
| 1,706,720 | A | 3/1929 | Wettstein | |
| 1,935,652 | A * | 11/1933 | Miller | B65D 43/0222 220/258.3 |
| 2,244,316 | A | 6/1941 | Robertson | |
| 3,187,919 | A | 6/1965 | Inglis | |
| 4,619,253 | A | 10/1986 | Anhauser et al. | |
| 4,630,729 | A | 12/1986 | Hirt et al. | |
| 5,927,530 | A * | 7/1999 | Moore | B65D 51/20 215/232 |
| 6,006,913 | A | 12/1999 | Ludemann et al. | |
| 6,474,490 | B1 | 11/2002 | Seibel et al. | |
| 6,857,561 | B2 | 2/2005 | Williams et al. | |
| 7,891,519 | B2 | 2/2011 | Matsukawa et al. | |
| 7,963,413 | B2 | 6/2011 | Sierra-Gomez et al. | |
| 8,167,162 | B2 | 5/2012 | Levey | |

(Continued)

FOREIGN PATENT DOCUMENTS

| | | |
|---|---|---|
| DE | 1747781 U | 6/1957 |
| DE | 8915007 U1 | 3/1990 |
| EP | 0549965 A1 | 7/1993 |

OTHER PUBLICATIONS

PCT International Search Report and Written Opinion, Int. Serial No. PCT/US2018/020832, Int. Filing Date: Mar. 5, 2018, Applicant: Owens-Brockway Glass Containers Inc., dated Mar. 5, 2018.

*Primary Examiner* — Shawn M Braden

(57) ABSTRACT

A peelable foil closure includes a base extending longitudinally along a first, longitudinal axis and laterally along a second, lateral axis, and a skirt extending from the base. The skirt includes a first portion including a circular edge having a predominant portion located on a first side of the second axis. The skirt also includes a second portion including a wavy edge, and a pull tab located on a second side of the second axis.

24 Claims, 3 Drawing Sheets

(56) References Cited

U.S. PATENT DOCUMENTS

| | | | | |
|---|---|---|---|---|
| 8,905,251 | B2 | 12/2014 | Kornfeld et al. | |
| 9,114,899 | B2 | 8/2015 | Jouin et al. | |
| 9,144,899 | B2 * | 9/2015 | Bryant | B25C 11/00 |
| 2003/0230547 | A1 | 12/2003 | Seibel et al. | |
| 2007/0187410 | A1 * | 8/2007 | Legorreta | B65D 51/20 220/375 |
| 2011/0056949 | A1 * | 3/2011 | Reiterer | B65D 77/2032 220/361 |
| 2012/0128835 | A1 | 5/2012 | Lyzenga et al. | |
| 2013/0270268 | A1 | 10/2013 | Lyzenga et al. | |
| 2014/0106048 | A1 * | 4/2014 | Harper | A23L 2/52 426/548 |
| 2014/0117250 | A1 * | 5/2014 | Vardiel | C02F 1/325 250/436 |
| 2014/0312039 | A1 * | 10/2014 | Abegglen | B65D 51/20 220/258.2 |
| 2015/0297005 | A1 * | 10/2015 | Janor | A47G 19/2272 220/359.1 |
| 2016/0001940 | A1 * | 1/2016 | Gustafson | B65D 51/20 215/305 |

* cited by examiner

PEELABLE FOIL CONTAINER CLOSURE HAVING A WAVY EDGE

This patent application discloses innovations to container closures and, more particularly, to foil closures for containers and related packages.

BACKGROUND

Many types of containers include a base, a body extending away from the base, a shoulder extending away from the body, a neck extending away from the shoulder, and a neck finish terminating the neck for accepting a closure. The neck finish typically includes circumferentially extending threads to cooperate with corresponding features of the closure, and a circular axial end surface to cooperate with a seal on an undersurface of the closure. U.S. Pat. No. 2,244,316 illustrates a glass container and closure of this type.

Other types of containers may be closed with peelable foil closures, which may include foil caps. The caps typically include circular base walls, and fully cylindrical skirts extending axially from the base walls. The foil caps are applied to neck finishes of the containers such that the base walls cover circular openings of the container neck finishes and the skirts extend along radially outer surfaces of the container neck finishes. Typically, only the base walls are adhered to top sealing surfaces of the container neck finishes. After application to a container, a skirt can become crimped to the container neck finish, thereby rendering the closure difficult to peel away froth the container. For example, when a user attempts to remove the foil closure from the container, the skirt deforms inwardly, creating a crimp around the neck finish. Such crimping creates resistance to upward pulling of the closure away from the container and artificially increases the peel force. Many approaches to facilitating removal of such closures from containers include improvements to material compositions of closure substrates, attachment layers, and/or adhesives.

BRIEF SUMMARY OF THE DISCLOSURE

The present disclosure embodies a number of aspects that can be implemented separately from or in combination with each other.

In an embodiment of the disclosure, a peelable foil closure includes a base extending longitudinally along a first, longitudinal axis and laterally along a second, lateral axis, and a skirt extending from the base. The skirt includes a first portion including a circular edge having a predominant portion located on a first side of the second axis. The skirt also includes a second portion including a wavy edge, and a pull tab located on a second side of the second axis.

BRIEF DESCRIPTION OF THE DRAWINGS

The disclosure, together with additional objects, features, advantages and aspects thereof, will be best understood from the following description, the appended claims and the accompanying drawings, in which:

DETAILED DESCRIPTION

A general object of the present disclosure, in accordance with one aspect thereof, is to provide a peelable foil closure that is easier to peel off of a container than at least some conventional peelable foil closures. The closure is easier to peel because less force is required to separate the closure from the container. In general, and in contrast to previous approaches, the closure includes a radially outer skirt having a unique geometry, including a semi-circular edge portion and a wavy edge portion, to selectively reduce purchase of the closure on the container. The unique shape results in a closure having hoop strength that is lower than conventional closures, to facilitate peeling of the closure away from the container.

Figure 1:
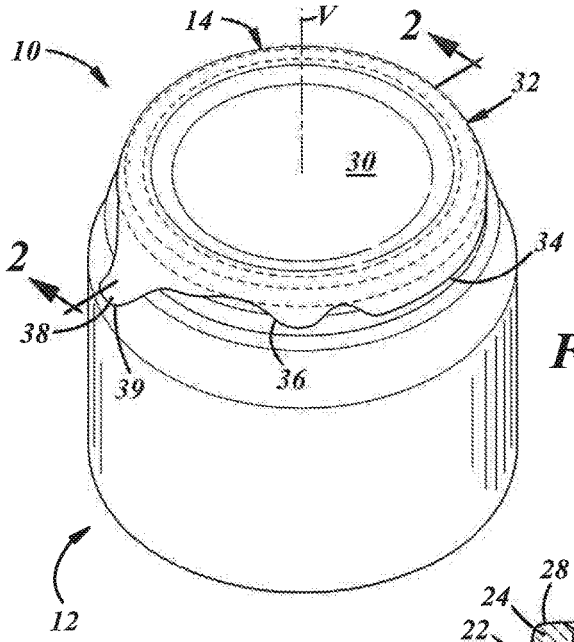
FIG. 1 is an upper perspective view of a package in accordance with an illustrative embodiment of the present disclosure, and including a container and a closure in accordance with an illustrative embodiment of the present disclosure.

More specifically, with reference to FIG. 1, an illustrative embodiment of a package 10 includes a container 12 and an illustrative embodiment of a closure 14 coupled to the container 12. The closure 14 is a peelable foil type of closure that may be adhered, heat sealed, or coupled to the container 12 in any other suitable manner. As used herein, the term "peelable" includes a closure that a user may peel off of a container by hand without requiring use of a bottle cap remover or other tool. The package 10 may be used to package, for example, pasta sauce, salsa, pickles, or any other food or beverage product(s) P. The package 10 also may be used to package other types of products including but not limited to liquids, gels, powders, particles, and the like. The package 10 includes a vertical axis V, across which the closure 14 may be peeled away from the container 12.

Figure 2:
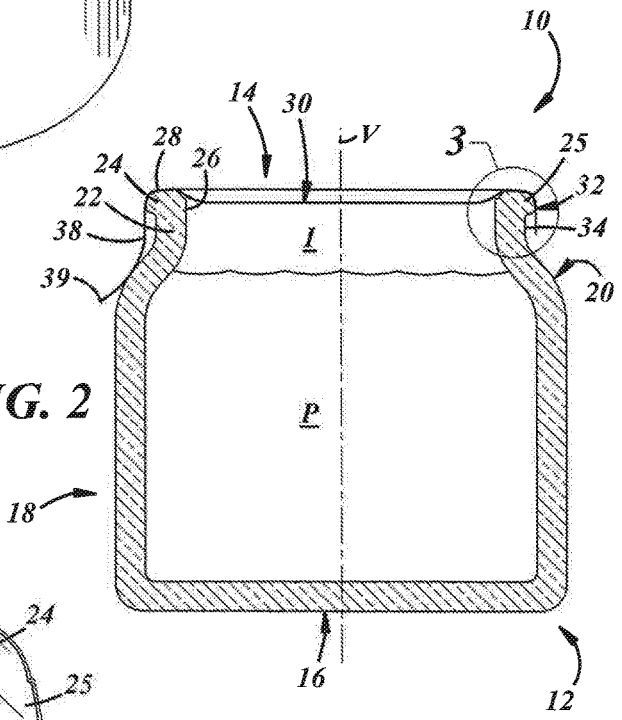
FIG. 2 is an elevational, cross-sectional view of the package of FIG. 1, taken along line 2-2 of FIG. 1.

With respect to FIG. 2, the container 12 may be composed of glass, metal, plastic, or any other material suitable for containing, for example, the types of products discussed above. The container 12 may include a base 16, a body 18 extending away from the base 16, a shoulder 20 extending away from the body 18, a neck 22 extending away from the shoulder 20, and a neck finish 24 terminating the neck 22 for accepting the closure 14. The neck finish 24 includes an open mouth 26 surrounded by a sealing surface 28 of the neck finish 24 and may include a bead or lip 25 that projects radially outwardly from the neck 22. The sealing surface 28 may be disposed in an axially facing orientation, for example, perpendicular to the axis V, at any angle between 45 and 90 degrees to the axis, or at any other angle to the axis suitable to facilitate sealing engagement with a corresponding portion of the closure 14. The container 12, with the closure 14 sealingly coupled thereto, establishes a package interior 1 and holds the product P within the package 10. Although the illustrated container 12 is generally of cylindrical cross-sectional shape, the container may be of polygonal, ovular, or any other cross-sectional shape.

The closure 14 may be composed of metallic material, polymeric material, cellulosic material, composite material, and/or any other material(s), suitable, for instance, for sealing to the container 12 and for peeling away therefrom in predominantly one piece. The material of the closure 14 may be a single unitary layer, or a laminate of two or more layers (not separately shown). For instance, the closure 14 may include a metal exterior layer, for example, of aluminum, and a polymeric interior layer, for example of polyethylene, polypropylene, or polyethylene terephthalate, or of custom polymeric compounds, or of any other suitable polymeric material. Also, in some embodiments, the closure 14 may include an adhesive.

In any case, the closure 14 is a relatively thinner and more flexible product in contrast to relatively thicker and more rigid products such as crown caps. Accordingly, the closure 14 may be in the form of a foil. As used herein, the term "foil" includes film, sheet, membrane, and/or the like. The foil, in its web or planar form, before being cut and formed into the closure 14, may be flaccid in contrast to stiff material like sheet metal used for crown caps. The thickness of the closure 14 may be, for example, 0.026 to 0.060 millimeters including all ranges, sub-ranges, and values therebetween, and, more particularly, between 0.029 and 0.047 millimeters including all ranges, sub-ranges, and values therebetween. The foil closure 14 is peelable from a container by hand, whereas, typically, a crown cap is inelastically bent off of a container by a user using a tool. For at least the foregoing reasons, crown caps have a specific utility known to those of ordinary skill in the art and are not suitable substitutes for foil closures, and vice-versa.

With reference to FIGS. 1 and 2, as coupled to the container 12, the closure 14 includes a base 30 and a skirt 32 extending from the base 30.

The skirt 32 includes a semi-circular radially outer periphery or edge 34 that may be bent or cupped to provide a stiffer closure that aids in orienting the closure 14 on the sealing surface 28 of the container 12 and that is easier to handle with mechanical handling equipment compared to a flat foil closure whose base would bend, fold, or otherwise deform during handling. As used herein, the terminology "semi-circular edge" includes edges that are not perfectly semi-circular or perfectly smooth and can include, for example, a finely serrated edge whose serration valleys are less than 0.5% of an overall diameter of the semi-circular edge of the closure 14. When the skirt 32 is bent or folded along the fold line 31 (FIG. 4), the semi-circular edge 34 may present significant hoop strength and resistance to peeling. The skirt 32 also includes a wavy radially outer periphery or edge 36 (FIG. 1) that also may be bent or cupped. In contrast to the portion of the skirt 32 at the semi-circular edge 34, the portion of the bent skirt 32 at the wavy edge 36 presents a relatively lower hoop strength to facilitate peeling of the closure 14 away from the container 12 as will be described in further detail herein below. The skirt 32 also includes a pull tab 38 that may extend from the wavy edge 36, may have an edge 39 that is a continuation of the wavy edge 36, or may be of any shape suitable to facilitate grasping by hand. The pull tab 38 may be folded downward over the finish along the fold line 31 (FIG. 4) such that the edge 39 extends below the edge of the skirt 34, or the pull tab 38 may be folded upward such that the edge 39 extends onto the base 30.

Figure 3:
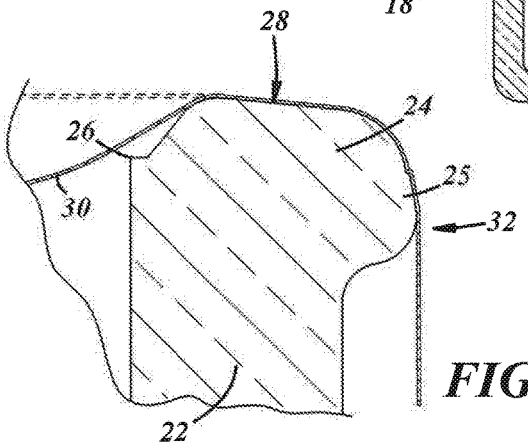
FIG. 3 is an enlarged, fragmentary, cross-sectional view of a portion of the package of FIG. 1, taken from circle 3 of FIG. 2, and illustrating a portion of the closure sealed to the container.

With reference to FIG. 3, the base 30 may include a sealing portion extending circumferentially continuously for 360 degrees, and sealably and removably coupled to a predominantly axially upwardly facing portion of the sealing surface 28 of the neck finish 24. Also, the skirt 32 may fold over the predominantly radially outwardly facing surfaces of the container neck finish 24 and container neck 22. The base 30 is illustrated in a concave shape under a vacuum condition, but those of ordinary skill in the art will recognize that the base 30 may take on a relatively flat or planar shape (as shown in dashed lines) in the absence of the vacuum condition.

Figure 4:
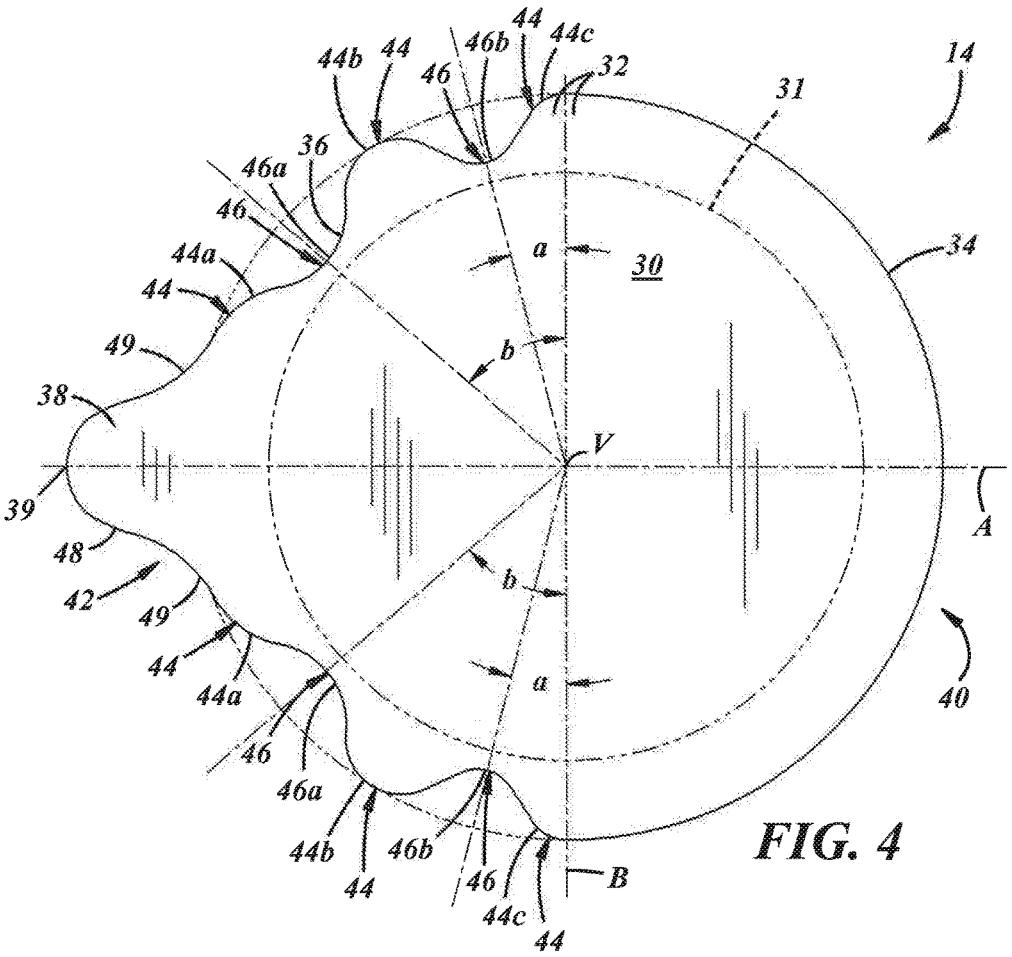
FIG. 4 is an enlarged top view of the closure from FIG. 1, but shown in a blank form.

With reference to FIG. 4, the closure 14 is illustrated in a blank form wherein the base 30 and the skirt 32 are co-planar such that the closure 14 is flat. The closure base 30 may extend along a first longitudinal axis A that may symmetrically bisect the closure 14 into lateral sides, and a second lateral axis B perpendicular to the first axis A that may divide the closure 14 into asymmetric longitudinal sides on either side of the lateral axis B. In addition to the first and second axes A, B, the closure 14 also may include a circumferential axis or circular fold line 31 where the skirt 32 meets the base 30. The base 30 may be completely circular as illustrated, but the skirt 32 is not. On a radially inner side of the fold line 31, the base 30 may be circumferentially and radially completely continuous in the form of a disk of circular shape. On a radially outer side of the fold line 31 (i.e. a radial margin), the skirt 32 may have portions that are circumferentially and completely continuous and other portions that are not. As indicated by reference numeral 33, the edge 34 does not extend in circular fashion to a pull tab, in contrast to prior art closures.

Accordingly, the closure 14 has an overall non-circular circumference including a first portion 40 including the semi-circular edge 34 extending circumferentially over at least a first angular extent of the first portion of the closure 14. A predominant portion of the edge 34 may be located on a first side of the second axis B. The overall non-circular circumference also includes a second portion 42 including the wavy edge 36 extending circumferentially over at least a second angular extent of the second portion 42 of the closure 14 and including the pull tab 38. As used herein the term "wavy" includes a series of undulating and wavelike curves. The semi-circular or first portion 40 may be located predominantly or entirely on the first side of the second axis B and may extend circumferentially over an angular extent of greater than or equal to 180 degrees, for instance, 180 degrees to 240 degrees including all ranges, sub-ranges, and values therebetween. Likewise, the wavy or second portion 42 may be located predominantly on a second side of the second axis B and may extend circumferentially over an angular extent of less than or equal to 180 degrees, for instance, 180 degrees to 120 degrees.

The wavy edge 36 may undulate in a sinusoidal shape, and may include at least one incurvate portion or valley. For example, the wavy edge 36 may include a plurality of lobes 44, and a plurality of valleys 46 between the lobes 44, for instance, on either side of the pull tab 38. One or more of the valleys 46 may be disposed between one of the lobes 44 and the semi-circular edge 34 of the first portion 40 of the closure 14. More specifically, one or more nadirs of one or more of the valleys 46 may be angularly spaced from the second axis B between 10 degrees and 60 degrees, including all ranges, sub-ranges, and values therebetween, for instance, as measured between radial lines that may bisect the valley(s) 46.

In the illustrated embodiment, for example, a nadir of a first one of the valleys 46 may be angularly spaced from the second axis B at a first angle a of approximately 15 degrees (e.g., 10 to 20 degrees, including all ranges, subranges, and values therebetween) on the second side of the second axis B. In other words, as illustrated, the nadirs of the first valleys 46 on either side of the first axis A are circumferentially spaced from one another over a first angular extent of approximately 210 degrees in one direction, or approximately 150 degrees in another direction. As used herein, the term "approximately" means plus or minus five degrees. Likewise, a nadir of a second one of the valleys 46 may be angularly spaced from the second axis B at a second angle b of about 45 degrees (e.g., 20 to 60 degrees, including all ranges, subranges, and values therebetween) on the second side of the second axis B. In other words, as illustrated, the nadirs of the second valleys 46 on either side of the first axis A are circumferentially spaced from one another over a first angular extent of approximately 270 degrees in one direction (and approximately 90 degrees in an opposite direction). In other embodiments, the closure 14 need not include the first valleys 46, such that the semi-circular edge 34 extends circumferentially over an angular extent of at least 220 degrees.

It is preferred that nadirs of the valleys 46 are spaced radially outwardly from the fold line 31, for example, one to five millimeters including all ranges, subranges, and values therebetween, and, more particularly, between two and three millimeters including all ranges, sub-ranges, and values therebetween. Accordingly, the portions of the skirt 32 at the semi-circular edge 34 and the wavy edge 36 are circumferentially continuous around the periphery of the container. This maintains exposed edges of the closure 14 out of a strongest part of an inductive field when induction energy is used to couple the closure 14 to the container 12, thereby minimizing or eliminating burning of the closure 14.

The wavy edge 36 may include first excurvate portions 44*a* on either side of the pull tab 38, and first incurvate portions 46*a* extending circumferentially from the first excurvate portions 44*a* on either side of the pull tab 38. The curvature of the portions 44*a*, 46*a* is referenced with respect to the axis V, such that the excurvate portions 44*a* curve outwardly and the incurvate portions 46*a* curve inwardly. Also, the wavy edge 36 further may include second excurvate portions 44*b* extending circumferentially from the first incurvate portions 46*a* on either side of the pull tab 38, and second incurvate portions 46*b* extending circumferentially from the second excurvate 44*b* portions on either side of the pull tab 38. Additionally, the wavy edge 36 further may include third excurvate portions 44*c* extending circumferentially from the second incurvate portions 46*b* on either side of the pull tab 38. The first excurvate portions 44*a* may be immediately circumferentially adjacent the pull tab 38, and the third excurvate portions 44*c* may be immediately circumferentially adjacent the semi-circular edge 34. At least one of the excurvate portions 44*a-c* may have an external radius of 0.4 to 7.0 mm and/or may be 0.5 to 10.5% of an overall diameter of the semi-circular edge. At least one of the incurvate portions 46*a-b* may have an internal radius of 0.4 to 25.0 mm and/or may be 0.5 to 37.0% of an overall diameter of the semi-circular edge.

The wavy edge 36 need not, and preferably does not, include sharp or jagged portions, for instance intersecting straight angled edges, straight angled edges intersecting rounded edges, or the like, which may facilitate ripping or tearing of the closure 14 and thereby result in poor peeling performance. Rather, the wavy edge 36 may be smoothly continuously curving, for instance, sinusoidally, to provide a reduction in hoop strength yet maintain integrity of the closure 14 when peeling forces are applied thereto.

Figure 5:
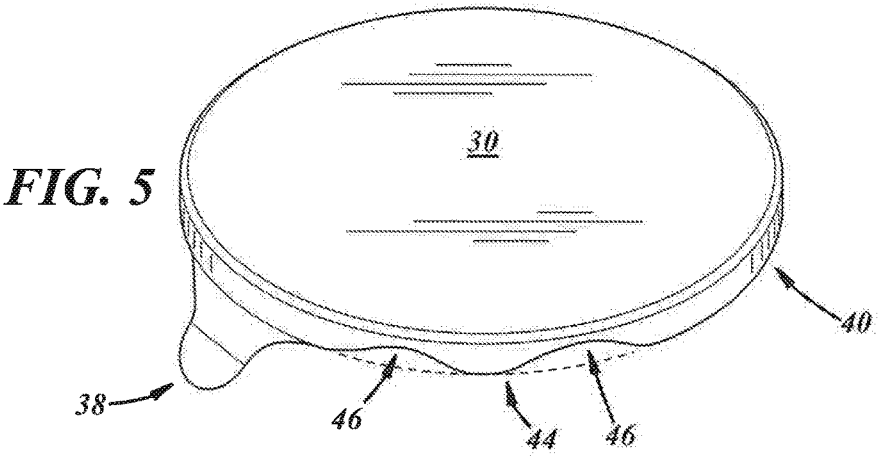
FIG. 5 is an enlarged perspective view of the closure from FIG. 4, but shown in a pressed or cupped form.

With reference to FIG. 5, the closure 14 may be produced in any suitable manner. For example, the closure 14 may be prepared from a web of material(s) that may be fed off of a roll of the material(s) and into a die press (not shown). The press may punch the web into a prevailingly two-dimensional blank, and bend certain portions thereof into the closure 14 including the base 30 and at least a portion of the skirt 32 extending therefrom with the first portion 40 and the second portion 42 extending circumferentially around the closure 14.

With reference to FIG. 1, the closure 14 may be assembled to the container 12 in any suitable manner. For example, in assembling the closure 14 to the container 12, the closure 14 may travel through a material handling chute (not shown) to a pick up location where the semi-circular edge portion 34 of the skirt 32 may be snagged or picked up by the container 12 passing by the pickup location and traveling on its own material handling conveyor (not shown). The closure 14 may be sealed to the container 12 by melting, adhering, welding, or in any other manner suitable to produce an air-tight seal.

Figure 6:
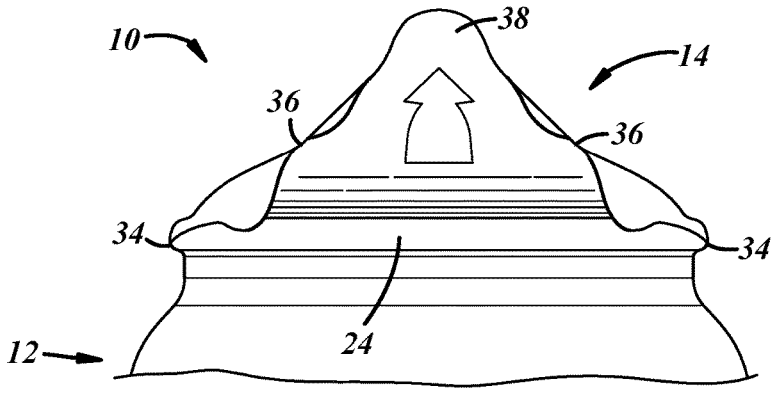
FIG. 6 is a fragmentary elevational view of an upper portion of the package of FIG. 1, illustrating the closure being peeled away from the container.

With reference to FIG. 6, the closure 14 may be removed from the container 12 more easily than at least some types of conventional peelable foil closures. In contrast to conventional types of peelable foil closures, the presently disclosed closure 14 with the wavy edge 36 minimizes resistance offered by crimping of the closure skirt 32 over the container neck finish 24, thereby significantly reducing lift forces required to peel the closure 14 off of the container 12. As used herein, the term "crimping" describes a situation in which, due to pulling motion during removal of a foil closure, a portion of the outer closure skirt 32 may be pulled or deformed into a position around or under a bead 25 or other feature on the outer portion of the contain neck finish 24, which then requires more force to peel the closure 14 over such feature. For example, testing reveals that the closure 14 of FIGS. 1-6 results in a peak peel force of 4.62 lbs. in contrast to a prior art closure, missing the novel features of the present disclosure but otherwise identical thereto, that results in a peak peel force of 7.99 lbs. Accordingly, the presently disclosed closure results in a reduction in peel force of over forty three percent.

Figure 7:
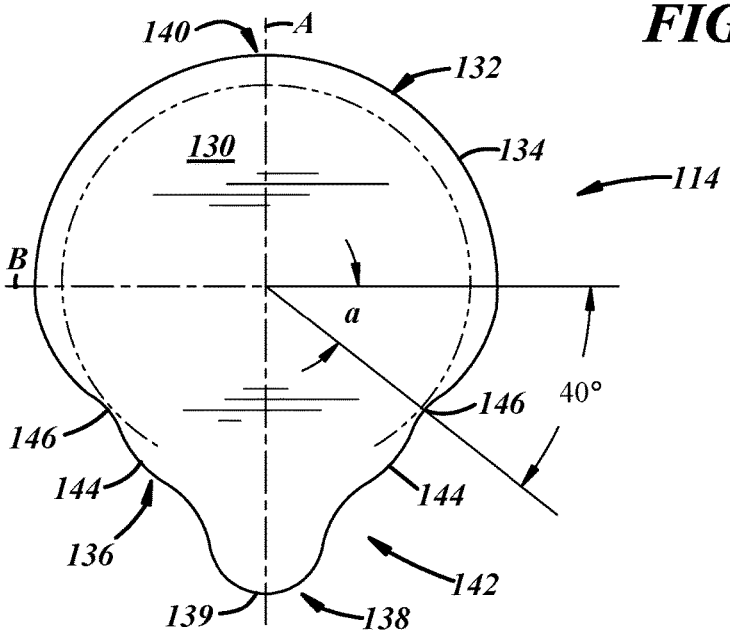
FIG. 7 is a top view of a closure in accordance with another illustrative embodiment of the present disclosure.

FIG. 7 illustrates another illustrative embodiment of a closure 114. This embodiment is similar in many respects to the embodiments of FIGS. 1-6 and like numerals between the embodiments generally designate like or corresponding elements throughout the several views of the drawing figures. Accordingly, the descriptions of the embodiments are hereby incorporated into one another, and description of subject matter common to the embodiments generally may not be repeated.

With reference to FIG. 7, the closure 114 includes a base 130 and a skirt 132 extending from the base 130. The skirt 132 includes a semi-circular radially outer periphery or edge 134 to help orient the closure 114 on a sealing surface of a container. Also, the skirt 132 includes a wavy radially outer periphery or edge 136, and a pull tab 138 that may extend from the wavy edge 136, may have an edge 139 that is a continuation of the wavy edge 136, or may be of any shape suitable to facilitate grasping by hand.

The closure base 130 may extend along a first longitudinal axis A that may symmetrically bisect the closure 114 into lateral sides, and a second, lateral axis B perpendicular to the first axis A that may divide the closure 114 into longitudinal sides. The closure 114 has an overall non-circular circumference including a first portion 140 including the semi-circular edge 134 extending circumferentially around at least a portion of the first portion of the closure 114. A predominant portion of the edge 134 may be located on a first side of the second axis B. The overall non-circular circumference also includes a second portion 142 including the wavy edge 136 extending circumferentially around at least a portion of the second portion 142 of the closure 114 and including the pull tab 138. The wavy edge 136 includes a primary excurvate portion or lobe 144 and a primary incurvate portion or valley 146, on either side of the pull tab 138. The valley 146 may be angularly spaced from the second axis B by a primary angle a of about 40 degrees, e.g. plus or minus 30 degrees, and including all ranges, sub-ranges, and values therebetween, for instance, as measured between a radial line that bisects the valley 146.

Five specimens of the closure 114 in accordance with the embodiment of FIG. 7 was fabricated for testing. Table 1 details the sample numbers, peak peel force values (lbs), average peel force values (lbs), performance notes, averages (Ave), and standard deviations (Std).

TABLE 1

| Closure 114 - FIG. 7 | | | | |
|---|---|---|---|---|
| 40 Degree | Sample | Peak | Average | Note |
| | 1 | 4.70 | 2.40 | Rip |
| | 2 | 5.40 | 2.70 | Good |
| | 3 | 4.70 | 3.20 | Good |
| | 4 | 5.60 | 3.10 | Good |
| | 5 | 5.60 | 2.90 | Good |
| | Ave | 5.20 | 2.86 | |
| | Std | 0.41 | 0.29 | |

There thus has been disclosed a peelable foil closure for a container, that fully satisfies one or more of the objects and aims previously set forth. The disclosure has been presented in conjunction with several illustrative embodiments, and additional modifications and variations have been discussed. Other modifications and variations readily will suggest themselves to persons of ordinary skill in the art in view of the foregoing discussion. For example, the subject matter of each of the embodiments is hereby incorporated by reference into each of the other embodiments, for expedience. The disclosure is intended to embrace all such modifications and variations as fall within the spirit and broad scope of the appended claims.

The invention claimed is:

1. A peelable foil closure comprising:

a base extending longitudinally along a first, longitudinal axis and laterally along a second, lateral axis; and a non-circular skirt extending from the base, and including:

a first portion including a semi-circular edge having a predominant portion located on a first side of the second axis, and a second portion including a wavy edge different in shape than the semi-circular edge and located on a second side of the second axis, and a pull tab located on the second side of the second axis, wherein the closure base extends along a first, longitudinal axis that symmetrically bisects the closure into lateral sides and a second, later axis perpendicular to the first axis that divides the closure into longitudinal sides, and wherein the wavy edge includes at least one lobe and at least one valley between the lobe and the semi-circular edge, wherein a nadir of the at least one valley is angularly spaced from the second axis at an angle between 10 and 60 degrees.

2. The closure of claim 1, wherein the semi-circular edge extends circumferentially over an angular extent of greater than 180 degrees, and the wavy edge extends circumferentially over an angular extent of less than 180 degrees.

3. A peelable foil closure comprising:

a base extending longitudinally along a first, longitudinal axis and laterally along a second, lateral axis; and a skirt extending from the base, and including:

a first portion including a semi-circular edge having a predominant portion located on a first side of the second axis, and a second portion including a wavy edge located on a second side of the second axis, and a pull tab located on the second side of the second axis, wherein the semi-circular edge extends circumferentially over an angular extent of 210 degrees to 230 degrees, and the wavy edge extends circumferentially over an angular extent of 150 degrees to 130 degrees.

4. The closure of claim 1, wherein the wavy edge is sinusoidal in shape.

5. The closure of claim 1, wherein the wavy edge includes a plurality of lobes and valleys between the lobes.

6. The closure of claim 1, wherein the wavy edge includes a lobe between two valleys on either side of the pull tab and wherein the pull tab has an edge that is a continuation of the wavy edge such that the wavy edge and the pull tab edge are continuously curving.

7. A peelable foil closure comprising:

a base extending longitudinally along a first, longitudinal axis and laterally along a second, lateral axis; and a non-circular skirt extending from the base, and including:

a first portion including a semi-circular edge having a predominant portion located on a first side of the second axis, and a second portion including a wavy edge different in shape than the semi-circular edge and located on a second side of the second axis, and a pull tab located on the second side of the second axis, wherein the wavy edge includes first excurvate portions on either side of the pull tab, first incurvate portions extending circumferentially from the first excurvate portions on either side of the pull tab, second excurvate portions extending circumferentially from the first incurvate portions on either side of the pull tab, second incurvate portions extending circumferentially from the second excurvate portions on either side of the pull tab, and third excurvate portions extending circumferentially from the second incurvate portions on either side of the pull tab.

8. The closure of claim 1, wherein the wavy edge includes excurvate portions disposed immediately circumferentially adjacent the pull tab.

9. The closure of claim 1, wherein the wavy edge includes excurvate portions disposed immediately circumferentially adjacent the semi-circular edge.

10. The closure of claim 1, wherein the wavy edge includes at least one excurvate portion having an external radius of 0.4 to 7.0 mm or of 0.5 to 10.5% of an overall diameter of the semi-circular edge.

11. The closure of claim 1, wherein the wavy edge includes at least one incurvate portion having an internal radius of 0.4 to 25.0 mm or of 0.5 to 37.0% of an overall diameter of the semi-circular edge.

12. A package, comprising:

a container having a neck finish with a radially outer surface and a sealing surface; and a peelable foil closure comprising:

a base extending longitudinally along a first, longitudinal axis and laterally along a second, lateral axis; and a non-circular skirt extending from the base, and including:

a first portion including a semi-circular edge having a predominant portion located on a first side of the second axis, and a second portion including a wavy edge different in shape than the semi-circular edge and located on a second side of the second axis, and a pull tab located on the second side of the second axis, the peelable foil closure including the base with a sealing portion circumferentially continuously extending around and removably coupled to a predominantly axially upwardly facing portion of the sealing surface, and including the skirt extending from the base and bent over the neck finish, wherein the wavy edge facilitates peeling of the closure away from the container.

13. The package of claim 12, wherein the pull tab is bent over the neck finish.

14. The package of claim 12, wherein the pull tab is folded onto the closure base.

15. The package of claim 12, wherein the container is a glass container.

16. A peelable foil closure for sealably closing a container, the closure comprising:

a base of circular disk shape and extending longitudinally along a first, longitudinal axis and laterally along a second, lateral axis; and a non-circular skirt extending from the base, and including:

a first portion including a semi-circular edge having a predominant portion located on a first side of the second axis, and a second portion including a pull tab located on a second side of the second axis, and an undulating edge different in shape than the semi-circular edge and located on a second side of the second axis circumferentially between the pull tab and the semi-circular edge of the first portion, wherein the closure base extends along a first, longitudinal axis that symmetrically bisects the closure into lateral sides and a second, later axis perpendicular to the first axis that divides the closure into longitudinal sides, and wherein the wavy edge includes at least one lobe and at least one valley between the lobe and the semi-circular edge, wherein a nadir of the at least one valley is angularly spaced from the second axis at an angle between 10 and 60 degrees.

17. The closure of claim 16, wherein the undulating edge is smoothly continuously curving without sharp or jagged portions.

18. The closure of claim 16, wherein the undulating edge includes circumferentially adjacent incurvate and excurvate portions on either side of the pull tab and wherein at least one of the excurvate portions has an external radius of 0.5 to 10.5% of an overall diameter of the semi-circular edge.

19. The closure of claim 16, wherein the wavy edge has a plurality of lobes and valleys between the lobes.

20. A peelable foil closure for sealably closing a container, the closure comprising:

a base of circular disk shape and extending longitudinally along a first, longitudinal axis and laterally along a second, lateral axis; and a non-circular skirt extending from the base, and including:

a first portion including a semi-circular edge extending more than half-way around a circumference of the closure and having a predominant portion located on a first side of the second axis, and a second portion including a pull tab located on a second side of the second axis, and an undulating edge, which is different in shape than the semi-circular edge, is disposed circumferentially between the pull tab and the semi-circular edge of the first portion, is smoothly continuously curving without sharp or jagged portions, and extends less than half-way around the circumference, wherein the closure base extends along a first, longitudinal axis that symmetrically bisects the closure into lateral sides and a second, later axis perpendicular to the first axis that divides the closure into longitudinal sides, and wherein the wavy edge includes at least one lobe and at least one valley between the lobe and the semi-circular edge, wherein a nadir of the at least one valley is angularly spaced from the second axis at an angle between 10 and 60 degrees.

21. The closure of claim 20, wherein the wavy edge is sinusoidal in shape with a plurality of lobes and valleys between the lobes, and wherein the undulating edge includes circumferentially adjacent incurvate and excurvate portions on either side of the pull tab and wherein at least one of the excurvate portions has an external radius of 0.5 to 10.5% of an overall diameter of the semi-circular edge.

22. A method of producing a package, comprising the steps of:

a) providing a container for holding contents, the container comprising a neck, and a neck finish terminating the neck and including an open mouth surrounded by a sealing surface, b) providing a peelable foil closure in a planar state, the closure comprising a base of circular disk shape and extending longitudinally along a first, longitudinal axis and laterally along a second, lateral axis, and a non-circular skirt extending from the base, and including a first portion including a semi-circular edge extending more than half-way around a circumference of the closure and having a predominant portion located on a first side of the second axis, and a second portion including a pull tab located on a second side of the second axis and also including an undulating edge, which is disposed circumferentially between the pull tab and the semi-circular edge of the first portion, is smoothly continuously curving without sharp or jagged portions, and extends less than half-way around the circumference;

c) bending at least the first portion of the closure out of the planar state into a semi-cylindrical shape; and d) after the bending step, applying the closure to the container.

23. The method of claim 22, wherein after the closure is applied to the container, the closure is sealed to the container.

24. A package produced by the method of claim 23.

* * * * *